US009169620B2

(12) United States Patent
Gabibulayev

(10) Patent No.: US 9,169,620 B2
(45) Date of Patent: Oct. 27, 2015

(54) WORK IMPLEMENT CONTROL SYSTEM

(75) Inventor: Magomed O. Gabibulayev, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 687 days.

(21) Appl. No.: 13/302,254

(22) Filed: Nov. 22, 2011

(65) Prior Publication Data

US 2013/0129460 A1 May 23, 2013

(51) Int. Cl.

| | |
|---|---|
| ***F15B 13/02*** | (2006.01) |
| ***F15B 21/08*** | (2006.01) |
| ***E02F 9/08*** | (2006.01) |
| ***E02F 9/20*** | (2006.01) |
| ***E02F 9/22*** | (2006.01) |
| ***F15B 11/044*** | (2006.01) |

(52) U.S. Cl.

CPC ..... *E02F 9/0883* (2013.01); *E02F 9/2029* (2013.01); *E02F 9/2095* (2013.01); *E02F 9/2203* (2013.01); *E02F 9/2217* (2013.01); *F15B 11/044* (2013.01); *F15B 2211/3052* (2013.01); *F15B 2211/30565* (2013.01); *F15B 2211/31558* (2013.01); *F15B 2211/353* (2013.01); *F15B 2211/6313* (2013.01); *F15B 2211/665* (2013.01); *F15B 2211/7053* (2013.01); *F15B 2211/761* (2013.01)

(58) Field of Classification Search

CPC ..... F15B 2211/30565; F15B 2211/45

USPC ..... 60/421, 429, 461

See application file for complete search history.

(56) References Cited

U.S. PATENT DOCUMENTS

| | | | | |
|---|---|---|---|---|
| 5,076,140 | A * | 12/1991 | Nelsen et al. | 91/235 |
| 5,960,695 | A | 10/1999 | Aardema et al. | |
| 6,092,454 | A * | 7/2000 | Vande Kerckhove | 91/464 |
| 6,212,886 | B1 * | 4/2001 | Sugiyama et al. | 60/422 |
| 6,267,041 | B1 | 7/2001 | Skiba et al. | |
| 6,286,412 | B1 | 9/2001 | Manring et al. | |
| 6,467,264 | B1 | 10/2002 | Stephenson et al. | |
| 7,251,935 | B2 * | 8/2007 | Zhang et al. | 60/461 |
| 7,387,061 | B2 * | 6/2008 | Kobata et al. | 91/405 |
| 7,634,911 | B2 * | 12/2009 | Brinkman | 60/414 |
| 7,827,787 | B2 | 11/2010 | Cherney et al. | |
| 2003/0159577 | A1 * | 8/2003 | Pfaff et al. | 91/525 |
| 2006/0168955 | A1 * | 8/2006 | Longfield et al. | 60/473 |
| 2007/0044650 | A1 | 3/2007 | Kuehn et al. | |
| 2007/0074509 | A1 | 4/2007 | Zhang et al. | |
| 2008/0104953 | A1 * | 5/2008 | Vigholm | 60/413 |
| 2009/0000290 | A1 | 1/2009 | Brinkman | |
| 2010/0024410 | A1 | 2/2010 | Brickner | |

FOREIGN PATENT DOCUMENTS

DE 10154056 A1 * 8/2002 ..... F15B 11/028

* cited by examiner

*Primary Examiner* — Dwayne J White
*Assistant Examiner* — Matthew Wiblin
(74) *Attorney, Agent, or Firm* — BakerHostetler

(57) ABSTRACT

A control system for a work implement on a machine is disclosed including a first hydraulic circuit, a second hydraulic circuit, and a controller. The first hydraulic circuit includes a hydraulic cylinder assembly, a pressurized fluid source, and a fluid tank. The hydraulic cylinder assembly includes a head end, a rod end, a cylinder, and a rod. The pressurized fluid source and the fluid tank are selectively connected to the head end or the rod end. The second hydraulic circuit includes a valve configured to receive a connection to tank signal and selectively connect the head end or the rod end to the fluid tank. The controller is configured to generate the connection to tank signal.

20 Claims, 5 Drawing Sheets

WORK IMPLEMENT CONTROL SYSTEM

TECHNICAL FIELD

The present disclosure relates generally to work implement control systems. Specifically, the disclosure relates to an implement control system including a hydraulic circuit and a hydraulic cylinder assembly.

BACKGROUND

Machines with work implement systems actuated with hydraulic circuits and hydraulic cylinder assemblies may size hydraulic control valves to allow operators more control when work implements are subject to over-running loads. This sizing of control valves may also allow fine control of work implement movements during operation. Although smaller cross-sectional areas of control valves may allow better control during certain work conditions, they may be less power efficient and slower to respond in comparison to larger cross-sectional areas of control valves, when work implements encounter resistive loads.

United States Patent Application Publication US 201010024410 A1 filed by Brickner discloses a hydraulic system for a machine. The hydraulic system includes an actuator with a first chamber and a second chamber, a first valve, a second valve, a third valve, and an operator input device displaceable from a neutral position to generate a signal indicative of a desired movement of the actuator. The hydraulic system further includes a controller configured to open the first and third valves by amounts related to a signal to pass fluid, and open the second valve by an amount related to the signal to pass fluid when the signal indicates a desire for increased actuator velocity. The third valve may continue to open during opening of the second valve.

SUMMARY OF THE INVENTION

A control system for a work implement on a machine is disclosed including a first hydraulic circuit, a second hydraulic circuit, and a controller. The first hydraulic circuit includes a hydraulic cylinder assembly, a pressurized fluid source, and a fluid tank. The hydraulic cylinder assembly includes a head end, a rod end, a cylinder, and a rod. The pressurized fluid source and the fluid tank are selectively connected to the head end or the rod end. The second hydraulic circuit includes a valve configured to receive a connection to tank signal, and selectively connect the head end or the rod end to the fluid tank. The controller is configured to generate the connection to tank signal.

A method of controlling a work implement on a machine is additionally disclosed. The work implement is operatively connected to a hydraulic cylinder assembly with a head end, and a rod end. The method includes directing fluid from the head end or the rod end to a tank through a first hydraulic circuit; commanding a work implement function; detecting a fluid pressure on the rod end; detecting a fluid pressure on the head end; generating a connection to tank control signal as a function of the work implement function, and the difference between the fluid pressure on the rod end and the fluid pressure on the head end; and directing fluid from the head end or the rod end to a tank through the first hydraulic circuit and a second hydraulic circuit as a function of generating the connection to tank signal.

A machine including a power source, a work implement control system, and a controller is additionally disclosed. The work implement control system includes a work implement, a first hydraulic circuit, and a second hydraulic circuit. The first hydraulic circuit includes a hydraulic cylinder assembly, a pressurized fluid source, and a fluid tank. The hydraulic cylinder assembly includes a head end, a rod end, a cylinder, and a rod operably connected to the work implement. The pressurized fluid source and the fluid tank are selectively connected to the head end or the rod end. The second hydraulic circuit includes a valve configured to receive a connection to tank signal and selectively connect the head end or the rod end to the fluid tank. The controller is configured to generate the connection to tank signal.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
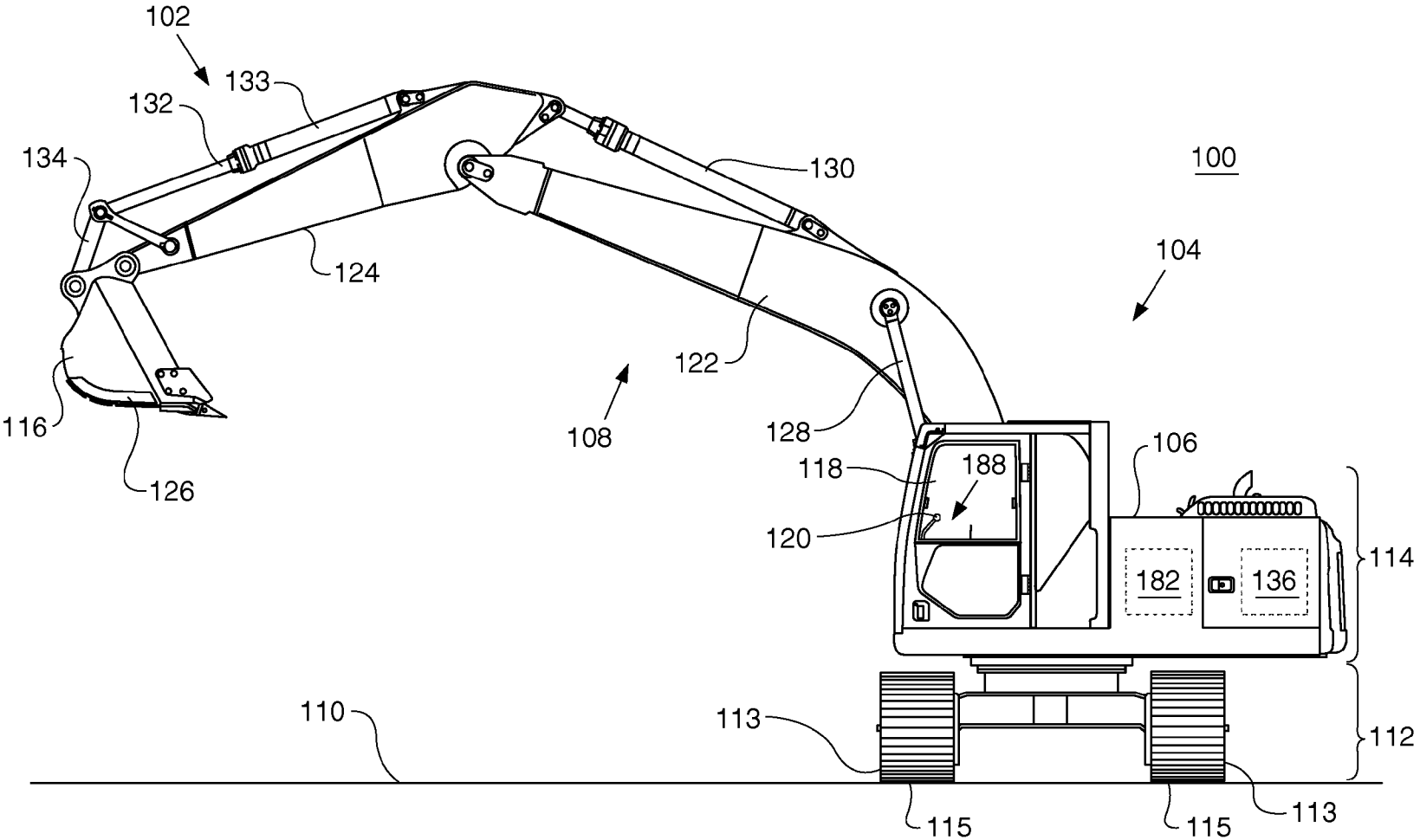
FIG. 1 illustrates an exemplary embodiment of a machine.

Referring now to FIG. 1, an exemplary embodiment of machine 100 is illustrated. In the embodiment illustrated, the machine 100 is depicted as a vehicle 104, and in particular an excavator 106. In other embodiments, the machine 100 may include any system or device for doing work. The machine 100 may include both vehicles 104 or stationary machines such as, but not limited to, machines which have hydraulically powered work implements or any other stationary machines that would be known to an ordinary person skilled in the art now or in the future.

The vehicle 104 may include but is not limited to vehicles that perform some type of operation associated with a particular industry such as mining, construction, farming, transportation, etc. and operate between or within work environments (e.g. construction site, mine site, power plants, on-highway applications, marine applications, etc.). Non-limiting examples of vehicle 104 include trucks, cranes, earthmoving vehicles, mining vehicles, backhoes, loaders, material handling equipment, farming equipment, locomotives and other vehicles which travel on tracks, and any type of movable machine that would be known by an ordinary person skilled in the art now or in the future. Vehicle 104 may include mobile machines which operate on land, in water, in the earth's atmosphere, or in space.

Non-limiting examples of a land embodiment of vehicle 104 include excavators 106, backhoe loaders, tracked or wheel loaders, compactors, feller bunchers, forestry machines, forwarders, harvesters, motor graders, pipe layers, skid steer loaders, telehandlers, wheeled or tracked dozers, or any other vehicle 104 which includes a work implement control system 108, 200, 300 as described in relation to the embodiments which follow as would be known to an ordinary person skilled in the art now or in the future.

Machine 100 is equipped with systems that facilitate the operation of machine 100 at worksite 110. In the depicted embodiment, these systems include a work implement system 108, a drive system 112, and a power system 114 that provides power to the work implement system 108 and the drive system 112. In the depicted embodiment, the power system 114 includes an engine 136, for example an internal combustion engine. In alternative embodiments the power system 114 may include other power sources such as electric motors (not shown), fuel cells, (not shown), batteries (not shown), ultra-capacitors (not shown), electric generators (not shown), and/or any power source that would be known by an ordinary person skilled in the art now or in the future.

The drive system 112 may include a transmission (not shown), and ground engaging devices 115. The transmission may include any device or group of devices that may transfer force between the power system 114 and the ground engaging devices 115. The transmission may include one or more of a mechanical transmission, any variator, gearing, belts, pulleys, discs, chains, pumps, motors, clutches, brakes, torque converters, fluid couplings and any transmission that would be known by an ordinary person skilled in the art now or in the future.

In the depicted embodiment, the ground engaging devices 115 include tracks 113. In alternative embodiments the ground engaging devices 115 may include wheels, compacting drums, rollers, or any other ground engaging device 115 which would be known by an ordinary person skilled in the art now or in the future.

The work implement system 108 includes a work implement 116, which may perform work at worksite 110. The work implement may include buckets, augers, blades, brooms, brushcutters, felling heads, forks, grapples, hammers, harvester heads, lift groups, material handling arms, mulchers, multi-processors, rakes, rippers, saws scarifiers, shears, stump grinders, snow plows and snow wings, tillers, trenchers, or any other work implement 116 which would be known by an ordinary person skilled in the art now or in the future.

The work implement system 108 may include any members, and linkages; as well as any systems and controls to actuate the members and linkages as a function of operator, autonomous system, or other inputs, to maneuver the work implement 116 to perform work at worksite 110, that would be known by an ordinary person skilled in the art now or in the future.

In the depicted embodiment of a excavator 106, the work implement system 108 includes a boom 122, a stick 124, a bucket 126, at least one boom cylinder assembly 128, a stick cylinder assembly 130, a work implement cylinder assembly 102, a work implement linkage 134, a controller 182, and an operator interface 188. The work implement cylinder assembly 102 includes a work implement cylinder 133, and a work implement rod 132. The operator interface 188 includes a joystick 120.

In the depicted embodiment, machine 100 includes a cab 118 including the operator interface 188. The operator interface 188 may include devices with which an operator communicates with, interacts with, or controls the machine 100. In one embodiment, the operator interface 188 may include devices with which the operator interacts physically. In another embodiment, the devices may operate with voice activation. In still other embodiments, the operator may interact with the operator interface 188 in any way a person skilled in the art would contemplate now or in the future.

The operator interface 188 may be operable to generate commands to the work implement control system 108 to move the work implement 116 to perform work at the worksite 110. The operator interface 188 may be operable to generate work implement system 108 control commands as a function of predetermined movement from an operator. In alternative embodiments, automatic machine controls encoded in the controller 182 onboard the machine 100, or an autonomous control system located remotely from the machine 100 may communicate work implement control system 108 commands.

The joystick 120 may include a hand operated lever-type control device, with a generally elongated shape, movable in at least one direction. The joystick 120 may be operable to move in several directions. The joystick 120 displacement in a direction may correspond to a work system control system 108 command. The joystick 120 may include operator control features in addition to displacement. For example, the joystick may include buttons or other depressible devices, switches, rotatable members, and slidable members. Control inputs may be functions of conditions, positions, or movements of the operator control features. The joystick 120 may include a portion with a handgrip or shape that is comfortable for an operator to grasp with a hand.

In alternative embodiments, the operator interface 188 may include (in addition to or instead of the joystick 120) switches, buttons, keyboards, interactive displays, levers, dials, remote control devices, voice activated controls, or any other operator input devices that a person skilled in the art would understand would be functional to allow an operator to control the machine 100.

In the depicted embodiment, an operator may enter commands to maneuver the work implement 116 through moving the joystick 120. These commands may be transmitted via sensors and communication links to the controller 182. The controller 182 may transmit signals via communication links to actuate hydraulic fluid valves to allow pressurized fluid flow to and from the cylinder assemblies 128, 130, 102 as is well known in the art. As pressurized fluid flows to and from the cylinder assemblies 128, 130, 102, rods (such as work implement rod 132) may extend from and/or retract into cylinders (such as work implement cylinder 133) to move the work implement 116. In other embodiments hydro-mechanical control systems may transmit operator commands to actuate the work implement 116.

In the depicted embodiment, a work implement linkage assembly 134 is operably connected to the work implement rod 132 and the work implement 116 to actuate work implement 116 in a desired way.

The controller 182 may include a processor (not shown) and a memory component (not shown). The processor may include microprocessors or other processors as known in the art. In some embodiments the processor may include multiple processors. The processor may execute instructions and generate outputs to implement a method or process Such instructions may be read into or incorporated into a computer readable medium, such as the memory component or provided external to processor. In alternative embodiments, hard-wired circuitry may be used in place of or in combination with software instructions to generate the connection to tank control signal as a function of detecting the resistive load. Thus embodiments are not limited to any specific combination of hardware circuitry and software.

The term "computer-readable medium" as used herein refers to any medium or combination of media that participates in providing instructions to processor for execution. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, or any other medium from which a computer or processor can read.

The memory component may include any form of computer-readable media as described above or which would be known to an ordinary person skilled in the art now or in the future. The memory component may include multiple memory components.

The controller 182 may be enclosed in a single housing. In alternative embodiments, the controller 182 may include a plurality of components operably connected and enclosed in a plurality of housings. The controller 182 may be located on-board the machine, or may be located off-board or remotely.

The controller 182 may be communicatively connected to the operator interface 188 to receive operator command signals, and operatively connected to hydraulic valves to control movement of the work implement 116. The controller 182 may be communicatively connected to one or more sensors or other devices to receive signals indicative of machine 100 system operating parameters. One or more of the operating parameters may be indicative of the work implement being under a resistive or overrunning mode. In an embodiment where the machine 100 is a an excavator 106 and the work implement 116 is a bucket 126, one or more of the operating parameters may be indicative of the excavator 106 being in a digging mode.

An operator, or an autonomous function, may desire to dig earth or other material at work site 110 with the depicted excavator 106, and then dump the material into a haul truck (not shown). As the work implement system 108 responds to dig commands, the rod 132 may extend from the cylinder 133 and the bucket 126 may move downwards and curl inward towards the stick 124 and cab 118, digging material and then holding it as is well known by ordinary persons skilled in the art. While the bucket 126 is digging, a resistive load is applied to the work implement cylinder assembly 102 as the earth resists the extension of the rod 132. Once the material is dug and contained in the bucket 126, gravitational force on the material applies an overrunning load on work implement cylinder assembly 102. Resistive and overrunning loads on cylinder assemblies are well known to ordinary persons skilled in the art.

The operator, or an autonomous function, may position the loaded bucket 126 containing the material over the haul truck, and then begin a dump function. During the dump function the rod 132 may be retracted into the cylinder 133 causing the bucket 126 to rotate outwards from the stick 124 and cab 118 and dump the material into the haul truck as is well known by ordinary persons skilled in the art. During the dump cycle gravitational forces on the material in the bucket 126 may apply both resistive and overrunning loads on work implement cylinder assembly 102.

Figure 3:
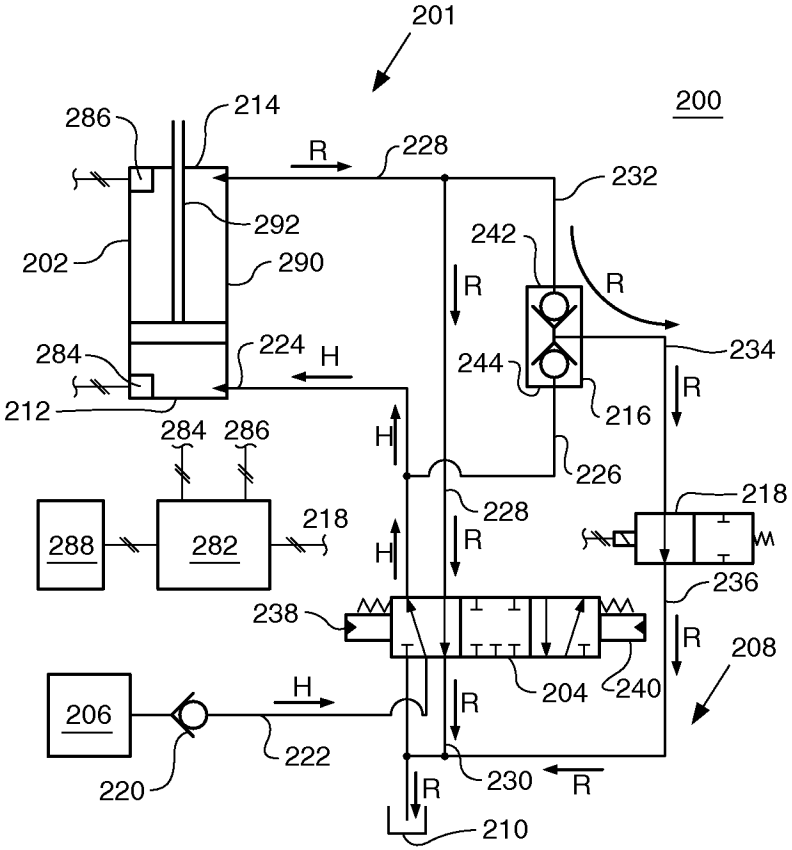
FIG. 3 illustrates the exemplary first embodiment of the work implement control system with the metering control valve in a rod extension position.
Figure 2:
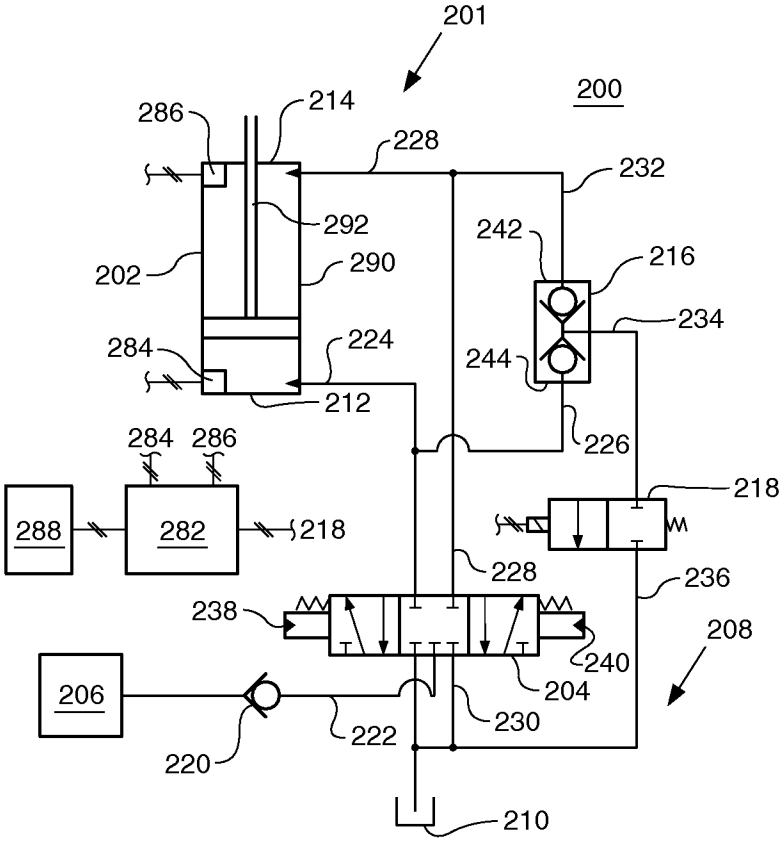
FIG. 2 illustrates an exemplary first embodiment of a work implement control system with a metering control valve in a neutral position.
Figure 4:
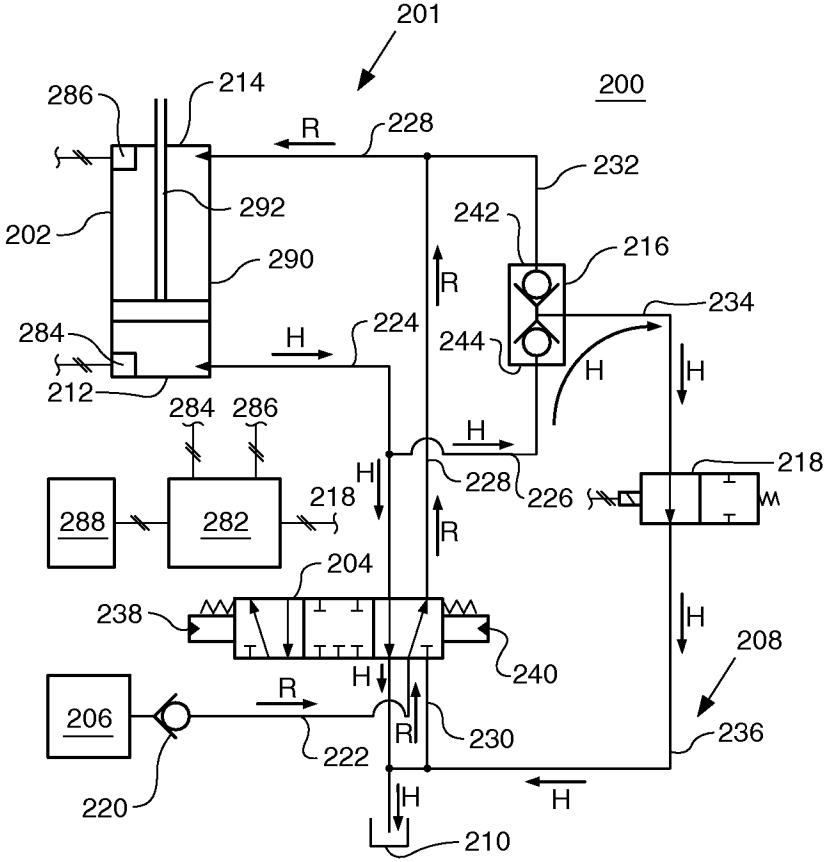
FIG. 4 illustrates the exemplary first embodiment of the work implement control system with the metering control valve in a rod retraction position.

Referring now to FIGS. 2, 3, and 4, a first embodiment of a work implement control system 200 is depicted. The system 200 includes a first hydraulic circuit 201, a second hydraulic circuit 208, and a controller 282.

The first hydraulic circuit 201 includes a hydraulic cylinder assembly 202, a pressurized fluid source 206, and a fluid tank 210. The cylinder assembly 202 includes a head end 212 having a head end pressure, a rod end 214 having a rod end pressure, a cylinder 290, and a rod 292. The rod 292 is operably connected to the work implement 116. The fluid source 206 is selectively fluidly connected to the head end 212 and the rod end 214. The fluid tank 210 is selectively fluidly connected to the head end 212 and the rod end 214. When the fluid source 206 is fluidly connected to the head end 212, generally, the fluid tank 210 is fluidly connected to the rod end 214. Conversely, when the fluid source 206 is fluidly connected to the rod end 214, generally, the fluid tank 210 is fluidly connected to the head end 212.

The cylinder assembly 202 may include any mechanical actuator operable to apply a substantially unidirectional force through a unidirectional stroke that would be known to an ordinary person skilled in the art now or in the future. The rod 292 may move back and forth in the cylinder 290 as is known by ordinary persons skilled in the art. The rod 292 may include a piston operable to divide the inside of the cylinder in two chambers, the head end 212 and the rod end 214.

In the excavator 106 embodiment depicted in FIG. 1, pressurized fluid may flow into the head end 212, extending the rod 292 from the cylinder 290, and closing the bucket 126. As pressurized fluid flows into the head end 212, fluid flows out of the rod end 214. Pressurized fluid may also flow into the rod end 214, retracting the rod 292 into the cylinder 290, and opening the bucket 126. As pressurized fluid flows into the rod end 214, fluid flows out of the head end 212.

The fluid source 206 may include any source of pressurized hydraulic fluid that would be known by an ordinary person skilled in the art now or in the future. The fluid source 206 may include a fixed displacement pump (not shown) or a variable displacement pump (not shown). In the depicted embodiment, engine 136 may drive fluid source 206 through one or more gears. In alternative embodiments, the fluid source 206 may include a pump driven in any manner known by an ordinary person skilled in the art now or in the future. Non-limiting examples include gear driven, belt driven, or electric motor driven pumps.

The fluid tank 210 may include any reservoir for holding fluid that would be known by an ordinary person skilled in the art now or in the future.

In the depicted embodiment the first hydraulic circuit includes a metering control valve 204. The metering control valve 204 may include three positions, a closed position as shown in FIG. 2, a rod extension position as shown in FIG. 3, and a rod retraction position as shown in FIG. 4. The metering control valve 204 may be spring loaded to the closed position.

In the depicted embodiment, the metering control valve 204 is actuated by hydraulic pilot fluid. The pilot fluid may be supplied by fluid source 206 or another fluid source not shown. Pilot fluid flow to the metering control valve 204 may be controlled by valves which are actuated by commands from the controller 282 or other mechanical or hydraulic means.

In the depicted embodiment, the head end 212 is fluidly connected to the metering control valve 204 via fluid conduit 224. The rod end 214 is fluidly connected to the metering control valve 204 through fluid conduit 228. The fluid source 206 is fluidly connected to the metering control valve 204 through a check valve 220 and fluid conduit 222. The tank 210 is fluidly connected to the metering control valve 204 through fluid conduit 230.

When the metering control valve 204 is in the closed position, pressurized fluid may not flow from the fluid source 206 to either the head end 212 or the rod end 214. When the metering control valve 204 is in the rod extension position as shown in FIG. 3, pressurized fluid may flow from the fluid source 206 through the check valve 220, through fluid conduit 222, through the metering control valve 204, and through fluid conduit 224 to the head end 212. When the metering control valve 204 is in the rod retraction position as shown in FIG. 4, pressurized fluid may flow from the fluid source 206 through the check valve 220, through fluid conduit 222, through the metering control valve 204, and through fluid conduit 228 to the rod end 214.

The metering control valve 204 may include a rod extension pilot port 238. When the pilot fluid exerts a force greater than the opposing spring force on the rod extension pilot port 238, the metering control valve 204 may move to the rod extension position. The metering control valve 204 may include a rod retraction pilot port 240. When the pilot fluid exerts a force greater than the opposing spring force on the rod retraction pilot port 240 the metering control valve 204 may move to the rod retraction position.

In alternative embodiments, the metering control valve 204 may be actuated to different positions through electrical current being applied to solenoids, or through pneumatic means. The metering control valve 204 may be actuated to change positions in any way which would be known to an ordinary person skilled in the art now or in the future.

The second hydraulic circuit 208 is configured to selectively fluidly connect one of the head end 212 and the rod end 214 to the fluid tank 210 as a function of a connection to tank control signal. In the depicted embodiment, the second hydraulic circuit 208 includes first directional control valve 218 and an inverse shuttle valve 216. The inverse shuttle valve 216 selectively fluidly connects either the head end 212, or the rod end 214, to the first directional control valve 218. The first directional control valve 218 selectively connects fluid from either the head end 212, or the rod end 214, to the tank 210.

The first directional control valve 218 includes an input port selectively fluidly connected to one of the head end 212 and the rod end 214. The first directional control valve 218 includes an output port fluidly connected to the tank 210 via fluid conduit 236.

In the depicted embodiment, the first directional control valve 218 is a two position, spring biased, normally closed, and electrically actuated directional valve. In alternative embodiments the first directional control valve 218 may include any device for controlling the flow of fluid in the second hydraulic circuit from either the head end 212 or the rod end 214 to the tank 210.

The first directional control valve 218 is operatively connected to the controller 282 to open in response to the connection to tank control signal. First directional control valve 218 may be a solenoid actuated valve and include a solenoid (not shown). The connection to tank control signal may include a sufficient amount of current being supplied to the solenoid from the controller 282 to open the directional control valve 218 and allow fluid from the head end 212 or the rod end 214 to flow through the first directional control valve 218 to the tank 210. In another embodiment, a power source (not shown), separate from the controller 282, may be operable to supply a sufficient amount of current to the solenoid to open the first directional control valve 218 as a function of the connection to tank control signal. In other embodiments the connection to tank signal may be any signal generated by the controller 282 which may cause the first directional control valve 218 to open, allowing fluid to flow from the head end 212 or the rod end 214 to the fluid tank 210, that would be known by an ordinary person skilled in the art now or in the future.

Although the first directional control valve 218 is shown as a solenoid actuated valve, it is contemplated that the first directional control valve 218 may be actuated by other means, such as, but not limited to, hydraulic pilot fluid or pneumatics.

In the depicted embodiment, the second hydraulic circuit 208 includes an inverse shuttle valve 216. The inverse shuttle valve 216 may include any valve that regulates the supply of fluid from more than one source into a single area of the circuit, by allowing the lower pressure source to flow through the valve. The inverse shuttle valve 216 includes an input rod port 242 fluidly connected to the rod end 214 through fluid conduit 232, an input head port 244 fluidly connected to the head end 212 through fluid conduit 226, and an output port selectively fluidly connected to the tank 210 through fluid conduits 234, 236 and the first directional control valve 218.

When the rod end 214 pressure is greater than the head end 212 pressure and the first directional control valve 218 opens in response to the connection to tank signal, fluid may flow from the head end 212, through fluid conduit 226, through the inverse shuttle valve 216, through fluid conduit 234, through the first directional control valve 218, through fluid conduit 236, and to the fluid tank 210. When the head end 212 pressure is greater than the rod end 214 pressure and the first directional control valve 218 opens in response to the connection to tank signal, fluid may flow from the rod end 214, through fluid conduit 232, through the inverse shuttle valve 216, through fluid conduit 234, through the first directional control valve 218, through fluid conduit 236, and to the fluid tank 210.

The controller 282 is as described in relation to controller 182 in FIG. 1. The controller 282 may be operably connected to first directional control valve 218 in such a way that the first directional control valve 218 opens in response to the controller 282 generating the connection to tank signal. In the embodiment depicted, the controller 282 may transmit the connection to tank signal as an electrical current to a solenoid actuator which opens the first directional control valve 218.

The work implement control system 200 may include a head end pressure sensor 284 configured to generate a head end pressure signal indicative of the head end pressure. The work implement control system 200 may include a rod end pressure sensor 286 configured to generate a rod end pressure signal indicative of the rod end pressure. The head end pressure sensor 284 and the rod end pressure sensor 286 may be any sensor operable to generate a pressure sensor indicative of hydraulic fluid pressure that would be known by an ordinary person skilled in the art now or in the future.

The controller 282 may be communicatively connected to a head end pressure sensor 284 to receive the head end pressure signal. The controller 282 may be communicatively connected to a rod end pressure sensor 286 to receive the rod end pressure signal.

The controller 282 may be communicatively and operatively connected to an operator interface 288 as described in relation to the controller 182 and the operator interface 188 of FIG. 1.

The controller 282 may detect a resistive load being applied to the work implement 116 as a function of operator commands received from the operator interface 288, the head end pressure signal, and the rod end pressure signal. Systems and methods for controllers 282 to detect resistive loads being applied to work implements 116 as functions of operator commands and actuator pressures are well known in the art. Systems and methods for controllers 282 to detect digging or other work implement 116 functions or modes as a function of operator commands and actuator pressures are also well known in the art.

In some embodiments, the controller 282 may detect a resistive load being applied to the work implement 116, as a function of automated commands from a solely or partially automated work function on the machine 100. In some embodiments the controller 282 may detect a resistive load being applied to the work implement 116, as a function of the difference between the head end pressure and the rod end pressure being equal to, and/or above a predetermined value.

In one example on an excavator 106, the controller 282 may detect that the operator is commanding a dig function through his commands to the work implement, boom, and stick cylinders 102 (or 202), 128, 130. As the operator commands the work cycle, he/she may command that the bucket 126 curl towards the stick 124 and cab 118 by commanding that the rod 132 (292) extend. The metering control valve 204 may move to the rod extension position, allowing pressurized fluid to flow from the fluid source 206 to the head end 212, and fluid to flow from the rod end 214 to the tank 210 through fluid conduit 228.

The pressurized fluid on the head end 212 pushing against the head of the rod 292 may begin extending the rod 292 from the cylinder 290 as is well known in the art. When the bucket 126 hits the ground of the worksite 110, the material the bucket 126 is digging into may exert a force against the rod 292 extending. This force may cause the head pressure to rise above the rod pressure. When the difference between the head end pressure and the rod end pressure is equal to or above a predetermined value, the controller 282 may generate a connection to tank signal, and the first directional control valve 218 may open allowing fluid from the rod end 214 to flow through the second hydraulic circuit 208 to the tank 210.

FIG. 3 exemplifies the above described example. When the controller 282 detects a dig cycle, and the head end pressure exceeds the rod end pressure by a predetermined value, the first directional control valve 218 opens in response to the controller 282 generating a connection to tank signal. The arrows marked "H" illustrate the flow of pressurized fluid to the head end 212. The pressurized fluid exits the fluid source 206, flows through the check valve 220 and fluid conduit 222 to the metering control valve 204. The pressurized fluid flows through the metering control valve 204, through fluid conduit 224, and into the head end 212 of cylinder assembly 202.

The arrows marked "R" illustrate the flow of fluid from the rod end 214 to tank 210. Fluid flows out of the rod end 214 of cylinder assembly 202, through fluid conduit 228 to metering control valve 204. The fluid flows through metering control valve 204 to tank 210.

The fluid also flows out of the rod end 214 of cylinder assembly 292, through fluid conduit 232 to rod port 242 of inverse shuttle valve 216. Since the head end pressure exceeds the rod end pressure, the fluid flows through the inverse shuttle valve 216 from its rod port 242, exiting through the output port and through fluid conduit 234 to the first directional control valve 218. Since the controller 282 has generated the connection to tank signal, the fluid flows through the first directional control valve 218 and through fluid conduit 236 to the tank 210.

In another example on an excavator 106, the controller 282 may detect that the operator is commanding a dump function during a work cycle through his commands to the work implement, boom, and stick cylinders 102 (or 202), 128, 130. As the operator commands the dump function, he/she may command that the bucket 126 curl out away from the cab 118 by commanding that the rod 132 (292) retract, while lifting the bucket 126, such that the material in the bucket 126 can be dumped in a truck or other holding vehicle. The metering control valve 204 may move to the rod retraction position, allowing pressurized fluid to flow from the fluid source 206 to the rod end 214, and fluid to flow from the head end 212 to the tank 210 through fluid conduit 224.

The pressurized fluid on the rod end 214 pushing against the head of the rod 292 may begin retracting the rod 292 into the cylinder 290 as is well known in the art. In a typical dumping function, the rod retraction may at first be aided by gravitational forces acting on the material in the bucket 126. But during a portion of the dumping function, gravitational forces on the material in the bucket 126 may be counter to the hydraulic fluid force retracting the rod 292 into the cylinder 290. When the bucket 126 encounters this situation and the gravitational forces on the material in the bucket 126 exert a force against the rod 292 retracting, the rod end pressure may rise above the head end pressure. When the difference between the head end pressure and the rod end pressure is equal and/or above a predetermined value, the controller 282 may generate a connection to tank signal, and the first directional control valve 218 may open allowing fluid from the head end 212 to flow through the second hydraulic circuit 208 to the tank 210.

FIG. 4 exemplifies the above described example. When the controller 282 detects a dump function during a work cycle, and the rod end pressure exceeds the head end pressure by a predetermined value, the first directional control valve 218 opens in response to the controller 282 generating a connection to tank signal. The arrows marked "R" illustrate the flow of pressurized fluid to the rod end 214. The pressurized fluid exits the fluid source 206, flows through the check valve 220 and fluid conduit 222 to the metering control valve 204. The pressurized fluid flows through the metering control valve 204, through fluid conduit 228, and into the rod end 214 of cylinder assembly 202.

The arrows marked "H" illustrate the flow of fluid from the head end 212 to tank 210. Fluid flows out of the head end 212 of cylinder assembly 202, through fluid conduit 224 to metering control valve 204. The fluid flows through metering control valve 204 to tank 210.

The fluid also flows out of the head end 212 of cylinder assembly 292, through fluid conduit 226 to head port 244 of inverse shuttle valve 216. Since the rod end pressure exceeds the head end pressure, the fluid flows through the inverse shuttle valve 216 from its head port 244, exiting through the output port and through fluid conduit 234 to the first directional control valve 218. Since the controller 282 has generated the connection to tank signal, the fluid flows through the first directional control valve 218 and through fluid conduit 236 to the tank 210.

The predetermined values for the differences between the rod end pressure and the head end pressure at which the controller 282 generates a connection to tank signal may be set depending on design and application parameters of the machine 100. Although one predetermined value may be ideal for a bucket digging, another may be better suited for bucket dumping. Other implements performing other functions may require different predetermined values.

Figure 5:
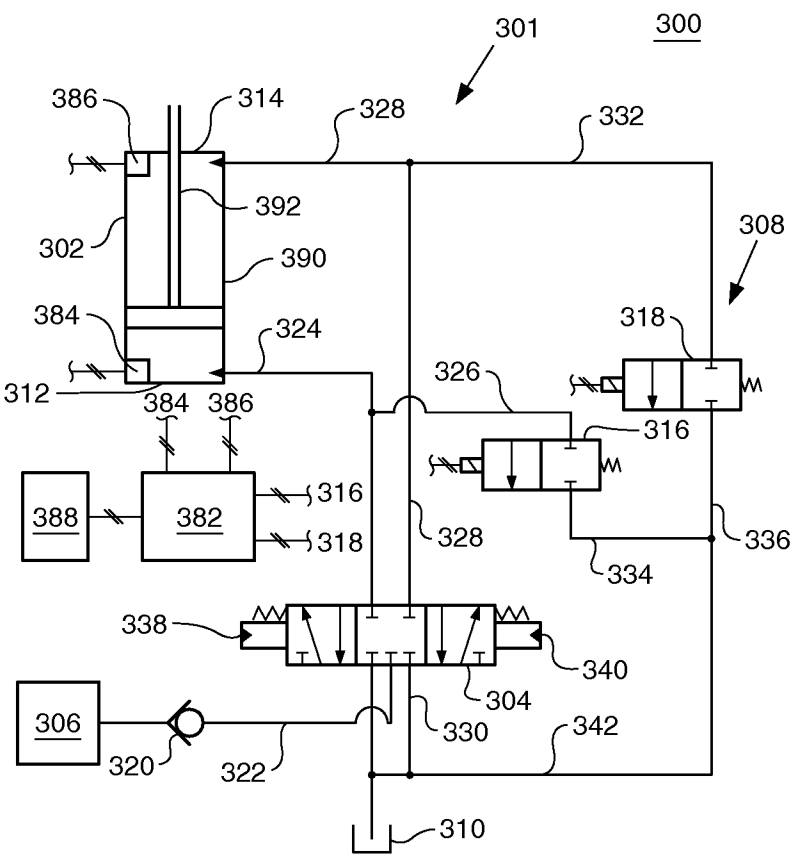
FIG. 5 illustrates an exemplary second embodiment of a work implement control system with a metering control valve in a neutral position.
Figure 7:
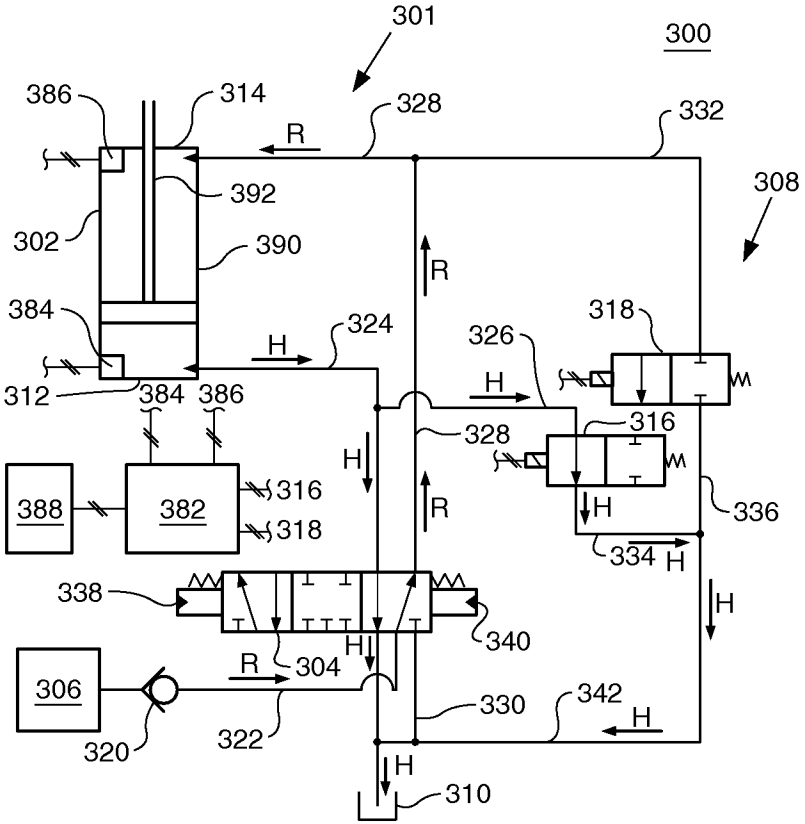
FIG. 7 illustrates the exemplary second embodiment of the work implement control system with the metering control valve in a rod retraction position.
Figure 6:
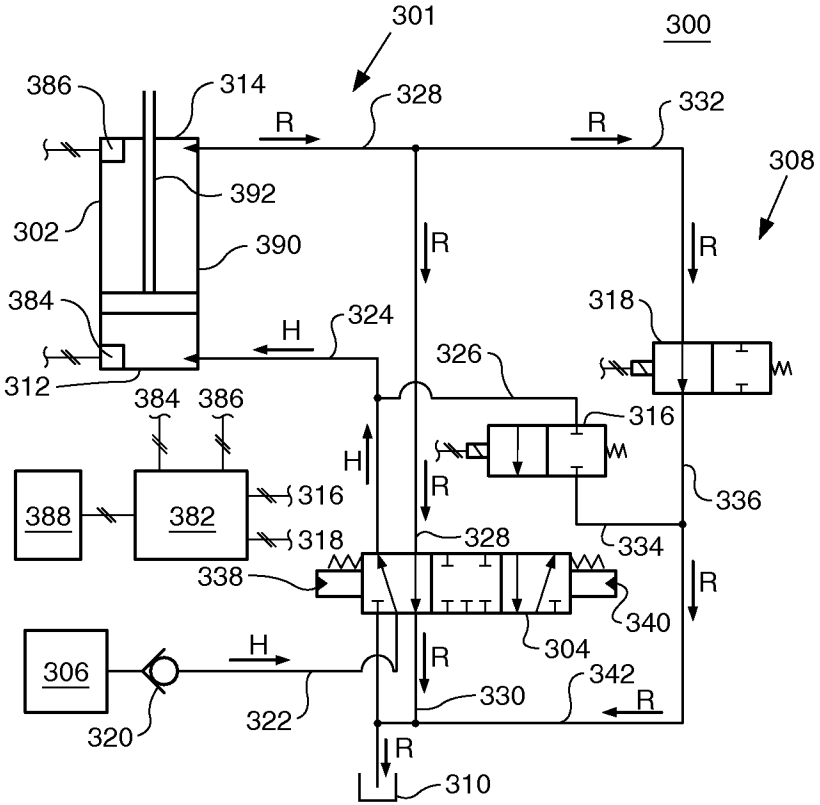
FIG. 6 illustrates the exemplary second embodiment of the work implement control system with the metering control valve in a rod extension position.

Referring now to FIGS. 5, 6, and 7, a second embodiment of the work implement control system 300 is depicted. The system 300 includes a first hydraulic circuit 301, a second hydraulic circuit 308, and a controller 382.

The first hydraulic circuit 301 includes a hydraulic cylinder assembly 302, a pressurized fluid source 306, and a fluid tank 310. The cylinder assembly 302 includes a head end 312 having a head end pressure, a rod end 314 having a rod end pressure, a cylinder 390, and a rod 392. The rod 392 is operably connected to the work implement 116. The fluid source 306 is selectively fluidly connected to the head end 312 and the rod end 314. The fluid tank 310 is selectively fluidly connected to the head end 312 and the rod end 314. When the fluid source 306 is fluidly connected to the head end 312, generally, the fluid tank 310 is fluidly connected to the rod end 314. Conversely, when the fluid source 306 is fluidly connected to the rod end 314, generally, the fluid tank 310 is fluidly connected to the head end 312.

The cylinder assembly 302 may include any mechanical actuator operable to apply a substantially unidirectional force through a unidirectional stroke that would be known to an ordinary person skilled in the art now or in the future. The rod 392 may move back and forth in the cylinder 390 as is known by ordinary persons skilled in the art. The rod 392 may include a piston operable to divide the inside of the cylinder in two chambers, the head end 312 and the rod end 314.

In the excavator 106 embodiment depicted in FIG. 1, pressurized fluid may flow into the head end 312, extending the rod 392 from the cylinder 390, and closing the bucket 126. As pressurized fluid flows into the head end 312, fluid flows out of the rod end 314. Pressurized fluid may also flow into the rod end 314, retracting the rod 392 into the cylinder 390, and opening the bucket 126. As pressurized fluid flows into the rod end 314, fluid flows out of the head end 312.

The fluid source 306 may include any source of pressurized hydraulic fluid that would be known by an ordinary person skilled in the art now or in the future. The fluid source 306 may include a fixed displacement pump (not shown) or a variable displacement pump (not shown). In the depicted embodiment, engine 136 may drive fluid source 306 through one or more gears. In alternative embodiments, the fluid source 306 may include a pump driven in any manner known by an ordinary person skilled in the art now or in the future. Non-limiting examples include gear driven, belt driven, or electric motor driven pumps.

The fluid tank 310 may include any reservoir for holding fluid that would be known by an ordinary person skilled in the art now or in the future.

In the depicted embodiment the first hydraulic circuit includes a metering control valve 304. The metering control valve 304 may include three positions, a closed position as shown in FIG. 5, a rod extension position as shown in FIG. 6, and a rod retraction position as shown in FIG. 7. The metering control valve 304 may be spring loaded to the closed position.

In the depicted embodiment, the metering control valve 304 is actuated by hydraulic pilot fluid. The pilot fluid may be supplied by fluid source 306 or another fluid source not shown. Pilot fluid flow to the metering control valve 304 may be controlled by valves which are actuated by commands from the controller 382 or other mechanical or hydraulic means.

In the depicted embodiment, the head end 312 is fluidly connected to the metering control valve 304 via fluid conduit 324. The rod end 314 is fluidly connected to the metering control valve 304 through fluid conduit 328. The fluid source 306 is fluidly connected to the metering control valve 304 through a check valve 320 and fluid conduit 322. The tank 310 is fluidly connected to the metering control valve 304 through fluid conduit 330.

When the metering control valve 304 is in the closed position, pressurized fluid may not flow from the fluid source 306 to either the head end 312 or the rod end 314. When the metering control valve 304 is in the rod extension position, pressurized fluid may flow from the fluid source 306 through the check valve 320, through fluid conduit 322, through the metering control valve 304, and through fluid conduit 324 to the head end 312. When the metering control valve 304 is in the rod retraction position, pressurized fluid may flow from the fluid source 306 through the check valve 320, through fluid conduit 322, through the metering control valve 304, and through fluid conduit 328 to the rod end 314.

The metering control valve 304 may include a rod extension pilot port 338. When the pilot fluid exerts a force greater than the opposing spring force on the rod extension pilot port 338, the metering control valve 304 may move to the rod extension position. The metering control valve 304 may include a rod retraction pilot port 340. When the pilot fluid exerts a force greater than the opposing spring force on the rod retraction pilot port 340 the metering control valve 304 may move to the rod retraction position.

In alternative embodiments, the metering control valve 304 may be actuated to different positions through electrical current being applied to solenoids, or through pneumatic means. The metering control valve 304 may be actuated to change positions in any way which would be known to an ordinary person skilled in the art now or in the future.

The work implement control system 300 may include a head end pressure sensor 384 configured to generate a head end pressure signal indicative of the head end pressure. The work implement control system 300 may include a rod end pressure sensor 386 configured to generate a rod end pressure signal indicative of the rod end pressure. The head end pressure sensor 384 and the rod end pressure sensor 386 may be any sensor operable to generate a pressure sensor indicative of hydraulic fluid pressure that would be known by an ordinary person skilled in the art now or in the future.

The second hydraulic circuit 308 is configured to selectively fluidly connect one of the head end 312 and the rod end 314 to the fluid tank 310 as a function of a connection to tank control signal. In the depicted embodiment, the second hydraulic circuit 308 includes first directional control valve 316, second directional control valve 318, fluid conduit 326, fluid conduit 332, fluid conduit 334, fluid conduit 336, and fluid conduit 342.

The first directional control valve 316 includes an input port fluidly connected to the head end 312. The first directional control valve 316 includes an output port fluidly connected to the tank 310 via fluid conduit 334 and fluid conduit 342. In the depicted embodiment, the first directional control valve 316 is a two position, spring biased, normally closed, and electrically actuated directional valve. In alternative embodiments the first directional control valve 316 may include any device for controlling the flow of fluid in the second hydraulic circuit from the head end 312 to the tank 310.

In one embodiment, the first directional control valve 316 may be operatively connected to the controller 382 to open in response to the connection to tank control signal when the metering control valve 304 is in the rod retraction position (shown in FIG. 7). First directional control valve 316 may be a solenoid actuated valve and include a solenoid (not shown). When the metering control valve 304 is in the rod retraction position, and the controller 382 generates the connection to tank signal; the first directional control valve 316 may receive a sufficient amount of current from the controller 382 to open and allow fluid from the head end 312 to flow through the first directional control valve 316 to the tank 310. In another embodiment, a power source (not shown), separate from the controller 382, may be operable to supply a sufficient amount of current to the solenoid to open the first directional control valve 316 as a function of the connection to tank control signal being generated and the metering control valve 304 being in the rod retraction position. In other embodiments the first directional control valve 316 may open, allowing fluid to flow from the head end 312 the fluid tank 310, in response to the controller 382 generating the connection to tank signal and the metering control valve 304 being in the rod retraction position in any manner that would be known by an ordinary person skilled in the art now or in the future.

In another embodiment where the machine 100 includes the excavator 106, and the work implement 116 includes the bucket, the first directional control valve 316 may be operatively connected to the controller 382 to open in response to the connection to tank control signal when the controller 382 detects a dump function. First directional control valve 316 may be a solenoid actuated valve and include a solenoid (not shown). When the controller 382 detects a dump function and generates the connection to tank signal; the first directional control valve 316 may receive a sufficient amount of current from the controller 382 to open and allow fluid from the head end 312 to flow through the first directional control valve 316 to the tank 310. In another embodiment, a power source (not shown), separate from the controller 382, may be operable to supply a sufficient amount of current to the solenoid to open the first directional control valve 316 as a function of the connection to tank control signal being generated and the controller 382 detecting a dump function. In other embodiments the first directional control valve 316 may open, allowing fluid to flow from the head end 312 the fluid tank 310, in response to the controller 382 generating the connection to tank signal and detecting a dump function, in any manner that would be known by an ordinary person skilled in the art now or in the future.

In another embodiment, the first directional control valve 316 may be operatively connected to the controller 382 to open in response to the connection to tank control signal and the rod end pressure being greater than the head end pressure. First directional control valve 316 may be a solenoid actuated valve and include a solenoid (not shown). When the rod end pressure is greater than the head end pressure, and the controller 382 generates the connection to tank signal; the first directional control valve 316 may receive a sufficient amount of current from the controller 382 to open and allow fluid from the head end 312 to flow through the first directional control valve 316 to the tank 310. In another embodiment, a power source (not shown), separate from the controller 382, may be operable to supply a sufficient amount of current to the solenoid to open the first directional control valve 316 as a function of the connection to tank control signal being generated and the rod end pressure being greater than the head end pressure. In other embodiments the first directional control valve 316 may open, allowing fluid to flow from the head end 312 the fluid tank 310, in response to the controller 382 generating the connection to tank signal and the rod end pressure being greater than the head end pressure in any manner that would be known by an ordinary person skilled in the art now or in the future.

Although the first directional control valve 316 is shown as a solenoid actuated valve, it is contemplated that the first directional control valve 316 may be actuated by other means, such as, but not limited to, hydraulic pilot fluid or pneumatics.

The second directional control valve 318 includes an input port fluidly connected to the rod end 314. The second directional control valve 318 includes an output port fluidly connected to the tank 310 via fluid conduit 336 and fluid conduit 342. In the depicted embodiment, the second directional control valve 318 is a two position, spring biased, normally closed, and electrically actuated directional valve. In alternative embodiments the second directional control valve 318 may include any device for controlling the flow of fluid in the second hydraulic circuit from the rod end 314 to the tank 310.

In one embodiment, the second directional control valve 318 may be operatively connected to the controller 382 to open in response to the connection to tank control signal when the metering control valve 304 is in the rod extension position (shown in FIG. 6). Second directional control valve 318 may be a solenoid actuated valve and include a solenoid (not shown). When the metering control valve 304 is in the rod extension position, and the controller 382 generates the connection to tank signal; the second directional control valve 318 may receive a sufficient amount of current from the controller 382 to open and allow fluid from the rod end 314 to flow through the second directional control valve 318 to the tank 310. In another embodiment, a power source (not shown), separate from the controller 382, may be operable to supply a sufficient amount of current to the solenoid to open the second directional control valve 318 as a function of the connection to tank control signal being generated and the metering control valve 304 being in the rod extension position. In other embodiments the second directional control valve 318 may open, allowing fluid to flow from the rod end 314 to the fluid tank 310, in response to the controller 382 generating the connection to tank signal and the metering control valve 304 being in the rod extension position in any manner that would be known by an ordinary person skilled in the art now or in the future.

In another embodiment where the machine 100 includes the excavator 106, and the work implement 116 includes the bucket, the second directional control valve 318 may be operatively connected to the controller 382 to open in response to the connection to tank control signal when the controller 382 detects a dig function. Second directional control valve 318 may be a solenoid actuated valve and include a solenoid (not shown). When the controller 382 detects a dig function and generates the connection to tank signal; the second directional control valve 318 may receive a sufficient amount of current from the controller 382 to open and allow fluid from the rod end 314 to flow through the second directional control valve 318 to the tank 310. In another embodiment, a power source (not shown), separate from the controller 382, may be operable to supply a sufficient amount of current to the solenoid to open the second directional control valve 318 as a function of the connection to tank control signal being generated and the controller 382 detecting a dig function. In other embodiments the second directional control valve 318 may open, allowing fluid to flow from the rod end 314 the fluid tank 310, in response to the controller 382 generating the connection to tank signal and detecting a dig function, in any manner that would be known by an ordinary person skilled in the art now or in the future.

In another embodiment, the second directional control valve 318 may be operatively connected to the controller 382 to open in response to the connection to tank control signal and the head end pressure being greater than the rod end pressure. Second directional control valve 318 may be a solenoid actuated valve and include a solenoid (not shown). When the head end pressure is greater than the rod end pressure, and the controller 382 generates the connection to tank signal; the second directional control valve 318 may receive a sufficient amount of current from the controller 382 to open and allow fluid from the rod end 314 to flow through the second directional control valve 318 to the tank 310. In another embodiment, a power source (not shown), separate from the controller 382, may be operable to supply a sufficient amount of current to the solenoid to open the second directional control valve 318 as a function of the connection to tank control signal being generated and the head end pressure being greater than the rod end pressure. In other embodiments the second directional control valve 318 may open, allowing fluid to flow from the rod end 314 to the fluid tank 310, in response to the controller 382 generating the connection to tank signal and the head end pressure being greater than the rod end pressure in any manner that would be known by an ordinary person skilled in the art now or in the future.

Although the second directional control valve 318 is shown as a solenoid actuated valve, it is contemplated that the second directional control valve 318 may be actuated by other means, such as, but not limited to, hydraulic pilot fluid or pneumatics.

The controller 382 is configured to generate the connection to tank control signal as a function of a resistive load being applied to the work implement 116. The controller 382 is as described in relation to controller 182 in FIG. 1.

The controller 382 may be communicatively connected to a head end pressure sensor 384 to receive the head end pressure signal. The controller 382 may be communicatively connected to a rod end pressure sensor 386 to receive the rod end pressure signal.

The controller 382 may be communicatively and operatively connected to an operator interface 388 as described in relation to the controller 182 and the operator interface 188 of FIG. 1.

The controller 382 may detect a resistive load being applied to the work implement 116 as a function of operator commands received from the operator interface 388, the head end pressure signal, and the rod end pressure signal. Systems and methods for controllers 382 to detect resistive loads being applied to work implements 116 as functions of operator commands and actuator pressures are well known in the art. Systems and methods for controllers 382 to detect digging, dumping, or other work implement 116 functions or modes as a function of operator commands and actuator pressures are also well known in the art.

In some embodiments, the controller 382 may detect a resistive load being applied to the work implement 116, as a function of automated commands from a solely or partially automated work function on the machine 100. In some embodiments the controller 382 may detect a resistive load being applied to the work implement 116, as a function of the difference between the head end pressure and the rod end pressure being equal to, and/or above a predetermined value.

In one example on an excavator 106, the controller 382 may detect that the operator is commanding a dig function during a dig mode through his commands to the work implement, boom, and stick cylinders 102 (or 302), 128, 130. As the operator commands the dig function, he/she may command that the bucket 126 curl towards the stick 124 and cab 118 by commanding that the rod 132 (392) to extend. The metering control valve 304 may move to the rod extension position, allowing pressurized fluid to flow from the fluid source 306 to the head end 312, and fluid to flow from the rod end 314 to the tank 310 through fluid conduit 328.

The pressurized fluid on the head end 312 pushing against the head of the rod 392 may begin extending the rod 392 from the cylinder 390 as is well known in the art. When the bucket 126 hits the ground of the worksite 110, the material the bucket 126 is digging into may exert a force against the rod 392 extending. This force may cause the head end pressure to rise above the rod end pressure. When the difference between the head end pressure and the rod end pressure is equal and/or above a predetermined value, the controller 382 may generate a connection to tank signal, and the second directional control valve 318 may open allowing fluid from the rod end 314 to flow through the second hydraulic circuit 308 to the tank 310.

FIG. 6 exemplifies the above described example. When the controller 382 detects a dig function during a dig cycle, and the head end pressure exceeds the rod end pressure by a predetermined value, the second directional control valve 318 opens in response to the controller 382 generating a connection to tank signal. The metering control valve 304 may be in the rod extension position during the dig function. The arrows marked "H" illustrate the flow of pressurized fluid to the head end 312. The pressurized fluid exits the fluid source 306, flows through the check valve 320 and fluid conduit 322 to the metering control valve 304. The pressurized fluid flows through the metering control valve 304, through fluid conduit 324, and into the head end 312 of cylinder assembly 302.

The arrows marked "R" illustrate the flow of fluid from the rod end 314 to tank 310. Fluid flows out of the rod end 314 of cylinder assembly 302, through fluid conduit 328 to metering control valve 304. The fluid flows through metering control valve 304 to tank 310.

The fluid also flows out of the rod end 314 of cylinder assembly 302, through fluid conduits 328 and 332 to the input port of second directional control valve 318. Since the controller 382 has generated the connection to tank signal, and the controller 382 has detected a dig function, the metering control valve 304 is in the rod extension position, and/or the head end pressure is greater than the rod end pressure; the fluid flows through the second directional control valve 318, and through fluid conduits 336 and 342, to the tank 310. Since the controller 382 has not detected a dump function, the metering valve 304 being in the rod retraction position, or the rod end pressure being greater than the head end pressure; first directional control valve 316 may remain in the closed position, and fluid from the head end 312 will not flow through the first directional control valve 316 to the tank 310.

In another example on an excavator 106, the controller 382 may detect that the operator is commanding a dump function during a work cycle through his commands to the work implement, boom, and stick cylinders 102 (or 302), 128, 130. As the operator commands the dump function, he/she may command that the bucket 126 curl out away from the cab 118 by commanding that the rod 132 (392) retract, while lifting the bucket 126, such that the material in the bucket 126 can be dumped in a truck or other holding vehicle. The metering control valve 304 may move to the rod retraction position, allowing pressurized fluid to flow from the fluid source 306 to the rod end 314, and fluid to flow from the head end 312 to the tank 310 through fluid conduit 324.

The pressurized fluid on the rod end 314 pushing against the head of the rod 392 may begin retracting the rod 392 into the cylinder 390 as is well known in the art. In a typical dumping function, the rod retraction may at first be aided by gravitational forces acting on the material in the bucket 126. But during a portion of the dumping function, gravitational forces on the material in the bucket 126 may be counter to the hydraulic fluid force retracting the rod 392 into the cylinder 390. When the bucket 126 encounters this situation and the gravitational forces on the material in the bucket 126 exert a force against the rod 392 retracting, the rod end pressure may rise above the head end pressure. When the difference between the rod end pressure and the head end pressure is equal and/or above a predetermined value, the controller 382 may generate a connection to tank signal, and the first directional control valve 316 may open allowing fluid from the head end 312 to flow through the second hydraulic circuit 308 to the tank 310.

FIG. 7 exemplifies the above described example. When the controller 382 detects a dump function during a work cycle, and the rod end pressure exceeds the head end pressure by a predetermined value, the first directional control valve 316 opens in response to the controller 382 generating a connection to tank signal. The metering control valve 304 may be in the rod retraction position during the dump function. The arrows marked "R" illustrate the flow of pressurized fluid to the rod end 314. The pressurized fluid exits the fluid source 306, flows through the check valve 320 and fluid conduit 322 to the metering control valve 304. The pressurized fluid flows through the metering control valve 304, through fluid conduit 328, and into the rod end 314 of cylinder assembly 302.

The arrows marked "H" illustrate the flow of fluid from the head end 312 to tank 310. Fluid flows out of the head end 312 of cylinder assembly 302, through fluid conduit 324 to metering control valve 304. The fluid flows through metering control valve 304 to tank 310.

The fluid also flows out of the head end 312 of cylinder assembly 302, through fluid conduit 326 to the input port of first directional control valve 316. Since the controller 382 has generated the connection to tank signal; and the controller 382 has detected a dump function, the metering control valve 304 is in the rod refraction position, and/or the rod end pressure is greater than the head end pressure; the fluid flows through the first directional control valve 316, and through fluid conduits 334 and 342, to the tank 310. Since the controller 382 has not detected a dig function, the metering valve 304 being in the rod extension position, or the head end pressure being greater than the rod end pressure; second directional control valve 318 may remain in the closed position, and fluid from the rod end 314 will not flow through the second directional control valve 318 to the tank 310.

The predetermined values for the differences between the rod end pressure and the head end pressure at which the controller 382 generates a connection to tank signal may be set depending on design and application parameters of the machine 100. Although one predetermined value may be ideal for a bucket digging, another may be better suited for bucket dumping. Other implements performing other functions may require different predetermined values.

INDUSTRIAL APPLICABILITY

When gravitational force on the material in the bucket 126, the force needed to dig material with bucket 126, or other forces apply a resistive load on work implement cylinder assembly 102, a fluid conduit for fluid to return to tank from the work implement cylinder assembly 102 with a restrictively small cross sectional area may cause unnecessary energy losses, and decrease productivity, through slowing work implement 116 response. A fluid conduit for fluid to return to tank from the work implement cylinder assembly 102 with too large a cross sectional area may cause the operator difficulty when fine movements of the work implement 116 are needed, may make load holding difficult, and/or may make control of the work implement 116 during overrunning loads difficult.

Figure 8:
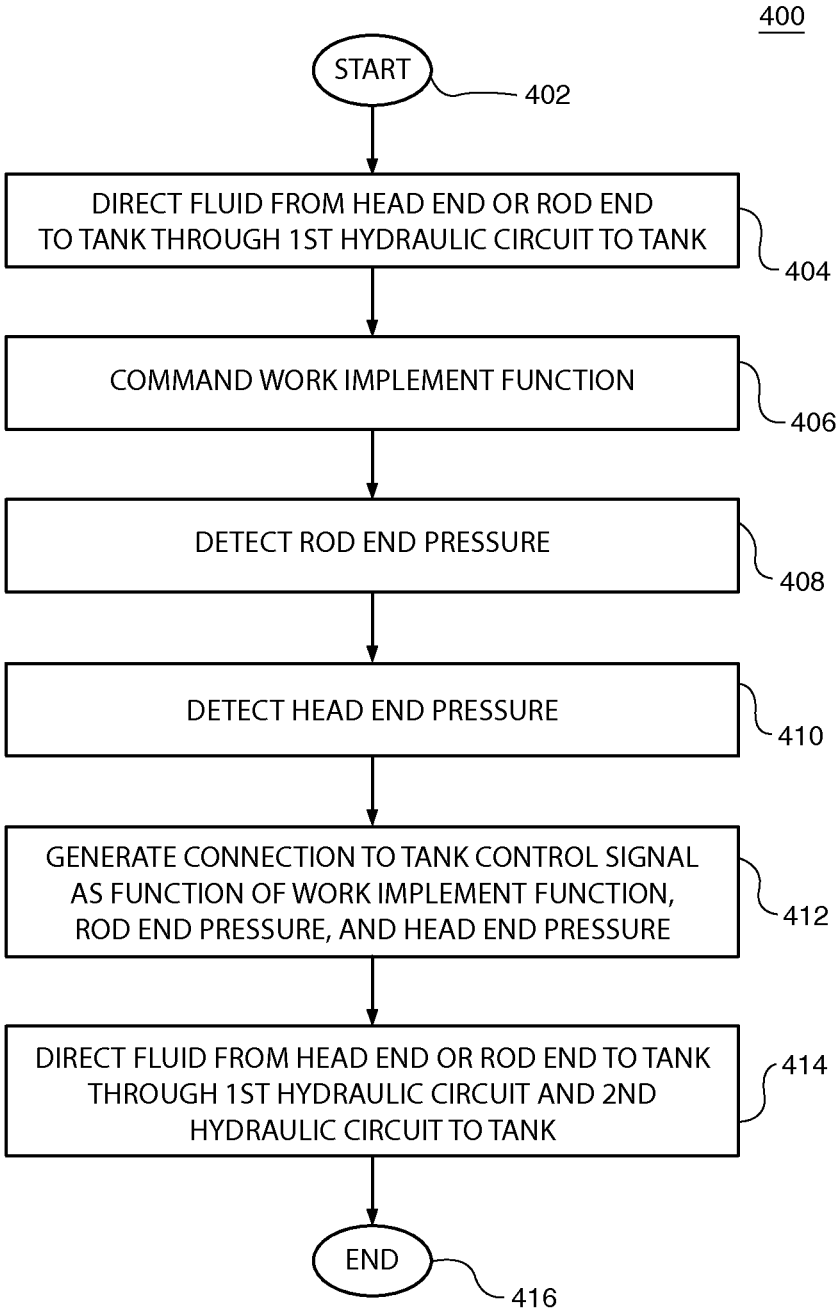
FIG. 8 illustrates an exemplary flow chart of a method to control a work implement on a machine.

Referring now to FIG. 8 a method 400 of controlling a work implement 116 on the machine 100 is depicted. The work implement 116 is operatively connected to the hydraulic cylinder assembly 102, 202, 302 with a head end 212, 312 and a rod end 214, 314. The head end 212, 312 includes a head end pressure. The rod end 214, 314 includes a rod end pressure. The method 400 includes directing fluid from one of the head end 212, 312 and the rod end 214, 314 to the tank 210, 310 through a first hydraulic circuit 201, 301; commanding a work implement 116 function; detecting the rod end pressure; detecting the head end pressure; generating a connection to tank control signal as a function of the work implement 116 function, and the difference between the rod end pressure and the head end pressure; and directing fluid from one of the head end 212, 312 and the rod end 214, 314 to the tank 210, 310 through the first hydraulic circuit 201, 301 and the second hydraulic circuit 208, 308 as a function of generating the connection to tank signal.

The method 400 starts at step 402 and proceeds to step 404. In step 404, fluid is directed from one of the head end 212, 312 and the rod end 214, 314 to the tank 210, 310. When the metering control valve 204, 304 is in the rod extension position, fluid may be directed from the rod end 214, 314 through fluid conduit 228, 328, through the metering control valve 204, 304, through fluid conduit 230, 330 and to the tank 210, 310. When the metering control valve 204, 304 is in the rod retraction position, fluid may be directed from the head end 212, 312 through conduit 224, 324, through the metering control valve 204, 304, through fluid conduit 230, 330 and to the tank 210, 310. The method proceeds to step 406.

In step 406, a work implement 116 function is commanded. The work implement 116 function may be commanded through the operator interface 188, 288, 388. In other embodiments, the work implement 116 function may be commanded through an autonomous or semi-autonomous system. In one embodiment, the work implement 116 may include the bucket 126. In this embodiment, the work implement 116 function may include a dig function or a dump function when the machine 100 is performing a work cycle. The controller 182, 282, 382 may be configured to detect certain work implement 116 functions such as a dig function or a dump function. The method 400 moves to step 408.

In step 408, the rod end pressure is detected. The rod end 214, 314 may include the rod end pressure sensor 286, 386 configured to generate a rod end pressure signal indicative of the rod end pressure. The controller 182, 282, 382 may be configured to receive the rod end pressure signal. The method 400 moves to step 410.

In step 410, the head end pressure is detected. The head end 212, 312 may include the head end pressure sensor 284, 384 configured to generate a head end pressure signal indicative of the head end pressure. The controller 182, 282, 382 may be configured to receive the head end pressure signal. The method 400 moves to step 412.

In step 412, the controller 182, 282, 382 generates a connection to tank signal as a function of the work implement 116 function, and the difference between the rod end pressure and the head end pressure. In one embodiment where the work implement 116 includes a bucket 126, and the work implement 116 function is a dig function, the controller 182, 282, 382 may generate the connection to tank signal as a function of the head end pressure being greater than the rod end pressure by a predetermined value. In another embodiment where the work implement 116 includes a bucket, and the work implement 116 function is a dump function, the controller 182, 282, 382 may generate the connection to tank signal as a function of the rod end pressure being greater than the head end pressure by a predetermined value. The method 400 moves to step 414.

In step 414, fluid is directed from one of the head end 212, 312 and the rod end 214, 314 to the tank 210, 310 through the first hydraulic circuit 201, 301 and the second hydraulic circuit 208, 308 as a function of generating the connection to tank signal. In some embodiments, fluid is directed from the head end 212, 312 or the rod end 214, 314 to the tank 210, 310 through opening a directional control valve 218, 316, 318 as a function of the generation of the connection to tank signal. The method moves to step 416 and ends.

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A control system for a work implement on a machine, comprising:

a first hydraulic circuit including a hydraulic cylinder assembly, the hydraulic cylinder assembly including a head end, a rod end, a cylinder, a rod, and a first valve that selectively connects either the head end or the rod end to a pressurized fluid source, and the other of the head end or the rod end to a fluid tank through a first path;

a second hydraulic circuit including a second valve that selectively connects either the head end or the rod end to the fluid tank through a second path, the second valve being configured such that if the head end has a lower pressure relative to the rod end, the second valve connects the head end to the fluid tank and if the rod end has a lower pressure relative to the head end, the second valve connects the rod end to the fluid tank; and a controller configured to generate a connection to tank control signal as a function of one or more parameters indicative of a resistive load being applied to the work implement.

2. The control system of claim 1 further including:

a head end pressure sensor configured to generate a head end pressure signal indicative of a fluid pressure on the head end, and a rod end pressure sensor configured to generate a rod end pressure signal indicative of a fluid pressure on the rod end, and wherein the controller is configured to generate the connection to tank control signal as a function of the head end pressure signal and the rod end pressure signal.

3. The control system of claim 2, wherein;

the second hydraulic circuit includes a third valve that is a spring biased, normally closed, and electrically actuated that includes;

an input port fluidly connected to the head end, and an output port fluidly connected to the fluid tank, and wherein the third valve is operatively connected to the controller to open in response to the connection to tank control signal when the rod end pressure is greater than the head end pressure.

4. The control system of claim 2, wherein;

the second hydraulic circuit includes a third valve that is a spring biased, normally closed, and electrically actuated that includes;

an input port fluidly connected to the rod end, and an output port fluidly connected to the fluid tank, and wherein the third valve is operatively connected to the controller to open in response to the connection to tank control signal when the rod end pressure is greater than the head end pressure.

5. The control system of claim 1 further including:

an operator interface configured to generate a signal indicating an operator work implement command, and wherein the controller is configured to generate the connection to tank control signal as a function of operator work implement command.

6. The control system of claim 1, wherein;

the second hydraulic circuit includes a third valve which is a spring biased, normally closed, and electrically actuated directional control valve including;

an input port selectively fluidly connected to one of the head end or the rod end, and an output port fluidly connected to the fluid tank, and wherein the third valve is operatively connected to the controller to open in response to the connection to tank control signal.

7. The control system of claim 1, wherein the second valve is an inverse shuttle valve including; a rod end input port fluidly connected to the rod end, a head end input port fluidly connected to the head end, and an output port selectively fluidly connected to the fluid tank.

8. The control system of claim 7, wherein;

the second hydraulic circuit includes a spring biased, normally closed, and electrically actuated third valve including;

an input port fluidly connected to the inverse shuttle valve output port, and an output port fluidly connected to the fluid tank, and the first directional control valve is operatively connected to the controller to open in response to the connection to tank control signal.

9. The control system of claim 1, wherein the first valve is a metering control valve having;

a closed position wherein the head end is not fluidly connected with the fluid source or the fluid tank, and the rod end is not fluidly connected with the fluid source or the fluid tank, a rod extension position wherein the head end is fluidly connected with the fluid source, and the rod end is fluidly connected with the fluid tank, and a rod retraction position wherein the head end is fluidly connected with the fluid tank, and the rod end is fluidly connected with the fluid source.

10. The control system of claim 9, wherein;

the second hydraulic circuit includes a third valve that is a spring biased, normally closed, and electrically actuated directional control valve including;

an input port fluidly connected to the head end, and an output port fluidly connected to the fluid tank, and wherein the third valve is operatively connected to the controller to open in response to the connection to tank control signal when the metering control valve is in the rod retraction position.

11. The control system of claim 9, wherein;

the second hydraulic circuit includes a third valve that is a spring biased, normally closed, and electrically actuated that includes;

an input port fluidly connected to the rod end, and an output port fluidly connected to the fluid tank, and wherein the third valve is operatively connected to the controller to open in response to the connection to tank control signal when the metering control valve is in the rod extension position.

12. The control system of claim 1, wherein;

the second hydraulic circuit includes a third valve that is a spring biased, normally closed, and electrically actuated directional control valve including;

an input port fluidly connected to the head end, and an output port fluidly connected to the fluid tank, and wherein the work implement is a bucket, the controller is configured to detect a dump function, and the third valve is operatively connected to the controller to open in response to the connection to tank control signal when the a dump function is detected.

13. The control system of claim 1, wherein;

the second hydraulic circuit includes a third valve that is a spring biased, normally closed, and electrically actuated that includes;

an input port fluidly connected to the rod end, and an output port fluidly connected to the fluid tank, and wherein the work implement is a bucket, the controller is configured to detect a dig function, and the third valve is operatively connected to the controller to open in response to the connection to tank control signal when the a dig function is detected.

14. A method of controlling a work implement operatively connected to a hydraulic cylinder assembly with a head end, and a rod end, on a machine, comprising:

directing fluid from a pressurized fluid source to one of the head end or the rod end and from the other of the head end or the rod end to a tank through a first path using a first valve of a first hydraulic circuit;

detecting fluid pressure on the rod end;

detecting fluid pressure on the head end; and if the fluid pressure of the rod end is less than the fluid pressure of the head end, selectively directing fluid from the rod end to a tank through a second path using a second valve of a second hydraulic circuit and, if the fluid pressure of the head end is less than the fluid pressure of the rod end, selectively directing fluid from the head end to the tank through the second path using the second valve of the second hydraulic circuit.

15. The method of claim 14, wherein the work implement is a bucket, the function is a dig function, and a connection to tank control signal is generated as a function of the fluid pressure on the head end being greater than the fluid pressure on the rod end by a predetermined value.

16. The method of claim 14, wherein the work implement is a bucket, the function is a dump function, and a connection to tank control signal is generated as a function of the fluid pressure on the rod end being greater than the fluid pressure on the head end by a predetermined value.

17. The method of claim 14, wherein the work implement function is commanded through an operator interface.

18. The method of claim 14, wherein the work implement function is commanded through an automated control.

19. The method of claim 14, further comprising, opening a directional control valve by generating a connection to tank signal.

20. A machine comprising:

a power source;

a work implement control system including;

a first hydraulic circuit including a hydraulic cylinder assembly, the hydraulic cylinder assembly including a head end, a rod end, a cylinder, a rod, and a first valve that selectively connects one of the head end or the rod end to a pressurized fluid source, and the other of the head end or the rod end to a fluid tank through a first path;

a second hydraulic circuit including a second valve that selectively connects one of the head end or the rod end to the fluid tank through a second path, the second valve being configured such that if the head end has a lower pressure relative to the rod end, the second valve connects the head end to the fluid tank and if the rod end has a lower pressure relative to the head end, the second valve connects the rod end to the fluid tank; and a controller configured to generate a connection to tank control signal as a function of one or more parameters indicative of a resistive load being applied to the work implement.

* * * * *